US006958697B2

(12) United States Patent
Morello et al.

(10) Patent No.: US 6,958,697 B2
(45) Date of Patent: Oct. 25, 2005

(54) CORE INSERT AND METHOD OF USE

(75) Inventors: Peter S. Morello, Plymouth, MA (US); Danny Earl Rines, Jefferson City, TN (US)

(73) Assignee: Nashua Corporation, Nashua, NH (US)

( * ) Notice: Subject to any disclaimer, the term of this patent is extended or adjusted under 35 U.S.C. 154(b) by 184 days.

(21) Appl. No.: 10/622,067

(22) Filed: Jul. 17, 2003

(65) Prior Publication Data

US 2004/0090332 A1 May 13, 2004

Related U.S. Application Data

(60) Provisional application No. 60/396,359, filed on Jul. 17, 2002.

(51) Int. Cl.[7] ..... G08B 13/14

(52) U.S. Cl. ..... 340/572.1; 340/568.1; 340/825.49; 235/375

(58) Field of Search ..... 340/539.13, 568.1, 340/572.1, 825.49; 235/375, 385

(56) References Cited

U.S. PATENT DOCUMENTS

| | | | | |
|---|---|---|---|---|
| 2,341,333 | A | 2/1944 | Purinton | |
| D210,594 | S | 3/1968 | Modrey | |
| 4,666,100 | A | 5/1987 | Price | |
| 4,852,821 | A | 8/1989 | Harris et al. | |
| 4,967,976 | A | 11/1990 | Kawai et al. | |
| 6,076,764 | A | 6/2000 | Robinson | |
| 6,089,453 | A | 7/2000 | Kayser et al. | |
| 6,653,940 | B2 * | 11/2003 | Collura | 340/572.8 |
| 6,802,659 | B2 * | 10/2004 | Cremon et al. | 400/76 |
| 2001/0049000 | A1 | 12/2001 | Conti et al. | |
| 2002/0045026 | A1 | 4/2002 | Conti et al. | |
| 2002/0089424 | A1 | 7/2002 | Collura | |
| 2005/0024465 | A1 * | 2/2005 | Kobayashi et al. | 347/107 |

FOREIGN PATENT DOCUMENTS

| | | | |
|---|---|---|---|
| WO | WO 9411846 A1 * | 5/1994 | G06K 19/077 |

OTHER PUBLICATIONS

Eastern Ribbon & Roll Products & Services, All New! Sensoroll, Secured Register Receipt Roll,http://easternribbon.com/products/sensoroll.html, printed Feb. 12, 2003 (posted on the internet and available at least as of Sep. 10, 2002), 3 pages.

Eastern Ribbon and Roll. Anti-theft device, All New! Roll, Secured Register Receipt Roll Brochure, available at least as of Apr. 24, 2002, 1 page.

* cited by examiner

*Primary Examiner*—Jeffery Hofsass
*Assistant Examiner*—George A. Bugg
(74) *Attorney, Agent, or Firm*—Kirkpatrick & Lockhart Nicholson Graham LLP

(57) ABSTRACT

The invention generally relates to roll core inserts disposed with a security device and methods of using such roll core inserts. More specifically, the invention relates to roll core inserts having a body that connects the inside planar surfaces of a first circular disk and a second circular disk and the outside planar surface of one of the disks has an engagement mechanism. A security device is disposed on the roll core insert.

11 Claims, 3 Drawing Sheets

CORE INSERT AND METHOD OF USE

This application claims priority to U.S. Provisional Patent Application Ser. No. 60/396,359 filed on Jul. 17, 2002, the entire contents of which are incorporated by reference herein.

FIELD OF THE INVENTION

The invention generally relates to roll core inserts and methods of using roll core inserts. More specifically, the invention relates to roll core inserts disposed with a security device.

BACKGROUND

Theft accounts for a significant portion of the losses incurred in the retail sector. A number of technologies have been implemented in retail stores in an attempt to reduce losses due to theft. For example, security devices such as electromagnetic and acoustomagnetic responsive transponders have been used to alert store personnel of an ongoing theft. The transponders have been manufactured into or in the shape of a label, e.g., a bar code label, to disguise their identity, and placed on the surface of the item. The transponders also have been placed inside retail items, e.g., inside the jacket of a book. However, over time, would-be perpetrators have learned to remove these labels, thus eliminating the theft protection afforded by these devices.

Further compounding this problem is the theft of register rolls for the purpose of printing fake receipts. The fake receipt and the stolen item then may be presented to the store for a cash refund. In this manner, stolen items can be converted to retail cash value.

SUMMARY OF THE INVENTION

The present invention addresses this problem by providing a core insert to which a security device can be affixed and then inserted into a roll core. For example, the core insert can be slid into a register roll core and affixed, e.g., by a pressure or friction fit between a portion of the core insert and the interior diameter of the roll core. Additionally or alternatively, adhesive can be used to affix the core insert to the interior of the register roll core. The portion of the core insert that is exterior to the register roll after insertion of the core insert preferably is configured to appear as a conventional register roll exterior. For example, the exterior can include a protrusion configured to engage machinery into which the roll is inserted and subsequently used. Upon insertion, the security device will trigger an alarm if a person attempts to remove a register roll from the premises.

In one aspect, the invention features a roll core insert including a first circular disk and a second circular disk. Each disk has an inside planar surface and an outside planar surface. A body connects the inside planar surface of the first circular disk and the inside planar surface of the second circular disk. A security device is disposed on the roll core insert. At least one of the outside planar surface of the first circular disk and the outside planar surface of the second circular disk includes an engagement mechanism, which enables placement within and/or retrieval from a machine, such as a fax or a cash machine. The engagement mechanism may be a tab that protrudes from and is exterior to the roll core insert or may be a pattern cut into a portion of the roll core insert, e.g., a star-shape or hexagonal-shape cut into the first circular disk.

In certain embodiments, the connecting body is a rectangular shape, e.g., a spar, that contacts at least a portion of a diameter of the first circular disk and at least a portion of a diameter of the second circular disk. Alternatively, the connecting body is substantially cylindrical. The cylindrical connecting body may have a diameter equal to or less than the diameter of the first circular disk or the second circular disk. The connecting body may be hollow, e.g., an annulus or a tube, or it may be solid, e.g., a solid cylinder. In one embodiment, a solid cylinder connecting body defines channels, e.g., hollowed out shapes that are parallel to the first circular disk. Alternatively, the solid cylinder connecting body defines channels that are perpendicular to the first circular disk. The channels may be uniformly- or irregularly-shaped. The channels may be positioned along the connecting body according to a uniform pattern or an irregular pattern. Various combinations of the above-described channels also are within the scope of the invention.

In certain embodiments, e.g., where the body is cylindrical, the security device is disposed on an exterior arced surface of the body. In other embodiments, the security device is disposed on an exterior flat surface of the body, e.g., a disk surface. The security device may be an electronic surveillance security device or a radio frequency identification device (RFID).

In another aspect, the invention features a method of using a roll core insert including providing a roll core insert having a security device and inserting the roll core insert into a roll. The roll may be a roll of paper, a roll of plastic or combinations thereof.

DESCRIPTION OF THE DRAWINGS

FIG. 1A is a top view of a first exemplary embodiment of the core insert of the present invention.

FIG. 1B is a top perspective view of the first exemplary embodiment.

FIG. 1C is a left side view of the first exemplary embodiment.

FIG. 1D is a front view of the first exemplary embodiment.

FIG. 1E is a top perspective view of the first exemplary embodiment with a security device and a register roll core.

FIG. 2A is a top view of a second exemplary embodiment of the core insert of the present invention.

FIG. 2B is a top perspective view of the second exemplary embodiment.

FIG. 2C is a rear view of the second exemplary embodiment.

FIG. 2D is a left side view of the second exemplary embodiment.

FIG. 2E is a front view of the second exemplary embodiment.

FIG. 2F is a top perspective view of the second exemplary embodiment with a security device and a register roll core.

DETAILED DESCRIPTION

Figure 1A:
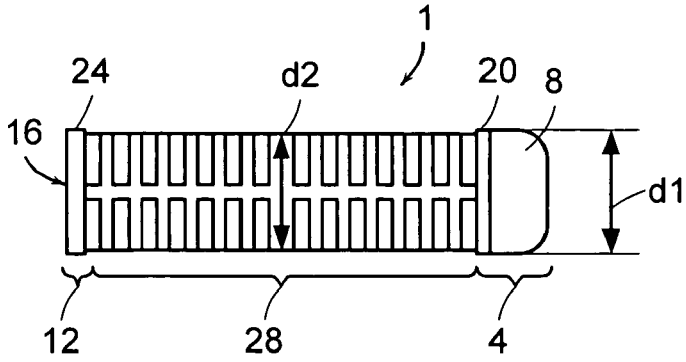
FIGS. 1A–E and 2A–F depict two exemplary embodiments, respectively, of core inserts of the present invention.
Figure 1B:
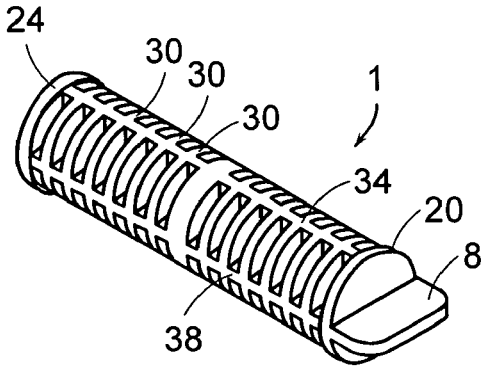
Figure 1C:
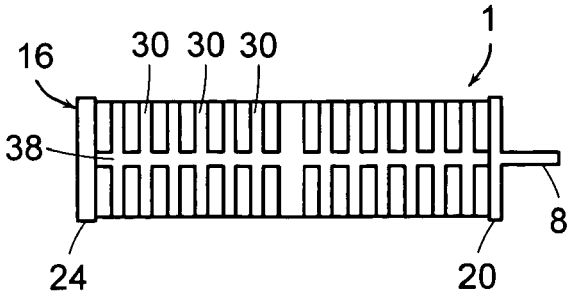
Figure 1D:
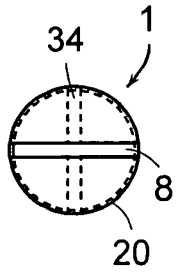

The present invention will now be described more fully with reference to the accompanying drawings, in which preferred configurations of the invention are shown. This invention may, however, be embodied in different forms and should not be construed as limited to the configurations depicted in the drawings. Rather, the drawings are provided so that this disclosure will be thorough and complete, and will convey the scope of the invention to those skilled in the art.

The terminology used in the description of the invention herein is for the purpose of describing particular configurations only, and is not intended to be limiting of the invention. As used herein, the singular articles "a," "an," and "the" are intended to include the plural forms as well, unless the context clearly indicates otherwise. Unless otherwise defined herein, all technical and scientific terms used herein have the same meaning as commonly understood by one of ordinary skill in the art to which this invention belongs.

The core insert of the present invention generally is configured to fit at least partially into a roll core, e.g., a register roll core or a fax roll core. The core insert includes one or more spars, disks, or other configurations that have a dimension about equal to the inside diameter of the roll core, and an interior portion that is adapted to receive a security device. The core insert can be manufactured using any known method, such as machining or extrusion. The core insert can be formed using various materials, including cellulosic and/or polymeric materials.

Any of various security devices can be used in connection with the present invention, including, but not limited to Electronic Article Surveillance (EAS) transponders or tags, including microwave, magnetic, acousto-magnetic and radio frequency transponders, and radio frequency identification device (RFID) tags, including magnetic coupled and electric field based RFID tags. Such devices are well known in the art and are readily and commercially available from companies such as Checkpoint Systems, Inc. (Thorofare, N.J.), and Sensormatic Electronics Corporation (Boca Raton, Fla.).

FIGS. 1A–E depict various views of an exemplary embodiment of the present invention. FIGS. 1A–E depict a core insert 1 that includes a first end 4 formed to define an exterior tab 8 and a second end 12 formed to define a flat, circular surface (outside planar surface) 16. Core inserts of the present invention can be formed to define any number of configurations on the ends. Preferably, however, the ends are formed to match configurations typically used on core inserts. For example, in FIGS. 1A–E, tab (engagement mechanism) 8 and surface 16 appear as a conventional register roll surfaces, where tab 8 is configured to engage a machine, such as a fax machine or cash register, for winding and unwinding the roll.

The first end 4 also forms a disk-shaped portion (first circular disk) 20, and the second end 12 also forms a disk-shaped portion (second circular disk) 24, both having a first diameter d1 that is equal to or about equal to an interior diameter d3 of a roll core 46 into which it is to be eventually inserted. Consequently, the disk-shaped portions 20, 24 will form a friction fit with the interior of a roll core 46. The disk-shaped portions may be placed at different positions along the insert, but preferably are on the ends of the core insert as shown in FIGS. 1A–E. Alternatively, the surface that engages the roll core interior diameter can be non-circular in cross section, e.g., containing one or more spars, provided it provides a means of engaging the interior diameter of the roll core 46.

Figure 1E:
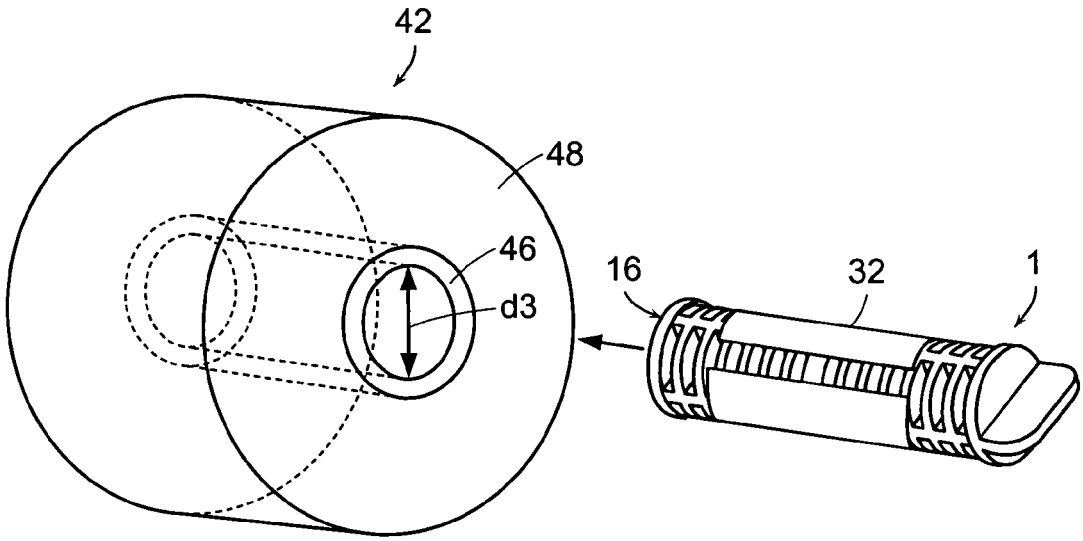

The core insert 1 also includes an interior portion (body) 28 that generally has a second diameter d2 less than the first diameter d1 of the disk-shaped portions 20 and 24. Interior portion 28 accommodates a security device 32, e.g., an antenna, as shown in FIG. 1E, which may be wound around an arced portion of the body. The interior portion can have numerous configurations, including the generally cylindrical shaped portion depicted in FIGS. 1A–E that includes a series of disk shaped portions 30 bisected twice by two perpendicular planar spars 34 and 38, each having a length matching the diameter d1. FIG. 1E also depicts exemplary register roll 42 that includes a roll core 46 and wound paper 48. The roll core 46 has a diameter d3 that is equal to or about equal to core insert diameter d1.

FIGS. 2A–2F depict a second exemplary embodiment of a core insert 101 that includes a first end 104 formed to define an exterior tab (engagement mechanism) 108 and a second end 112 formed to define a flat, circular surface (outside planar surface) 116. As stated above, the core insert of the present invention can be formed to define any number of configurations on the ends. Preferably, however, the ends are formed to match configurations typically used on core inserts. For example, in FIGS. 2A–F, tab 108 and surface 116 appear as a conventional roll surfaces, where tab 108 is configured to engage a machine, such as a fax machine or cash register, for winding and unwinding the roll.

Figure 2A:
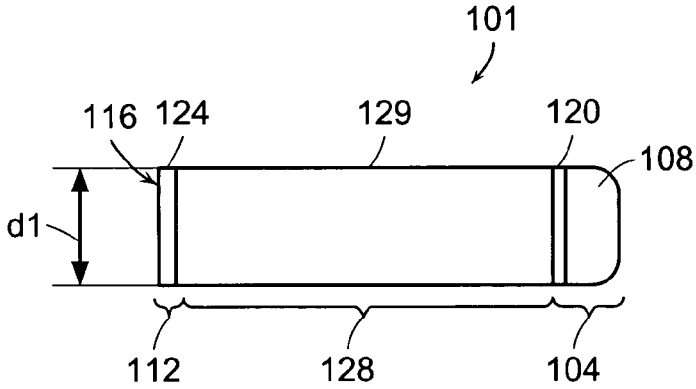
Figure 2B:
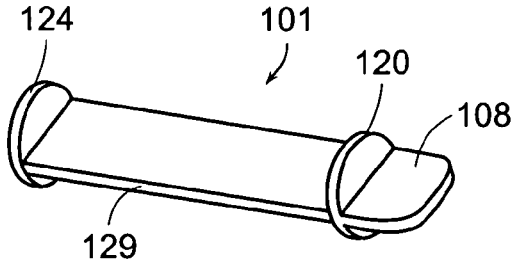
Figure 2D:
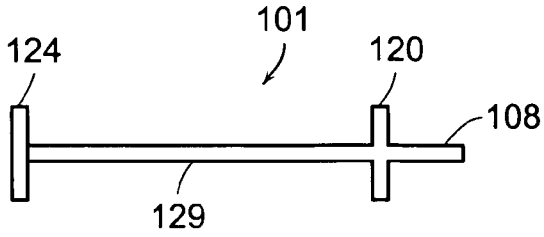
Figure 2C:
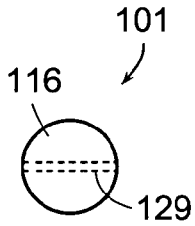
Figure 2E:
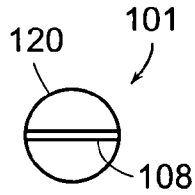
Figure 2F:
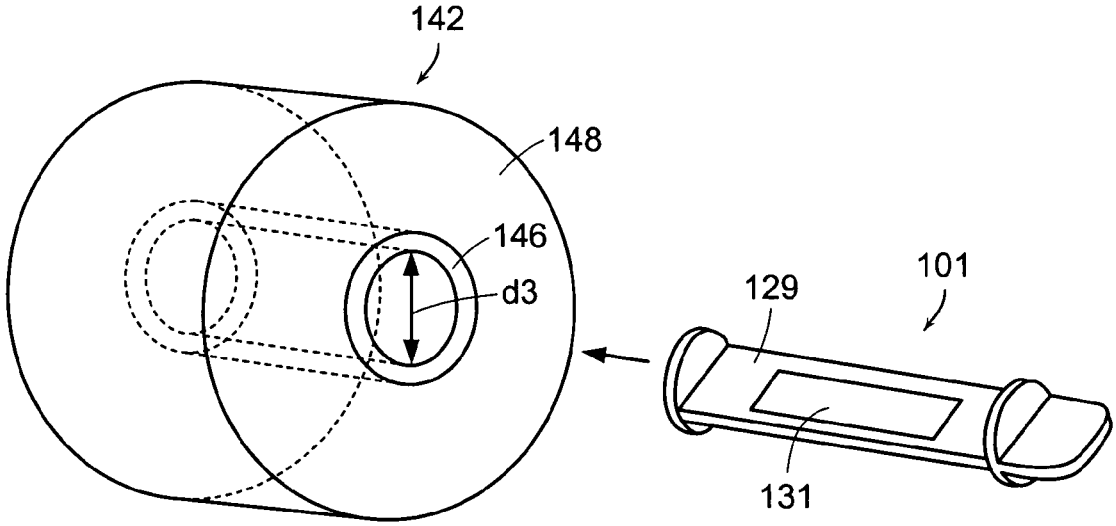

The first end 104 forms a disk-shaped portion (first circular disk) 120, and the second end 112 forms a disk-shaped portion (second circular disk) 124. Both disk-shaped portions 120, 124 have a diameter d1 that is about equal to an interior diameter d3 of a roll core 142 such as that depicted in FIG. 2F, so the core insert 101 will form a friction fit with the interior of the roll core 142. The disk-shaped portions may be placed at different positions along the insert, but preferably are on the ends of the core insert as shown in FIGS. 2A–F. The core insert 101 also includes an interior portion (body) 128 that forms a spar 129 to accommodate a security device 131 as shown in FIG. 2F. The interior portion 128 can have numerous configurations, including but not limited to, additional spars. FIG. 2F also depicts exemplary register roll 142 that includes a roll core 146 and wound paper 148. The roll core 146 has a diameter d3 that is equal to or about equal to core insert diameter d1.

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes that come within the meaning and range of equivalency of the claims are intended to be embraced therein.

We claim:

1. A roll core insert comprising:

a first circular disk having an inside planar surface and an outside planar surface;

a second circular disk having an inside planar surface and an outside planar surface;

a body connecting the inside planar surface of the first circular disk and the inside planar surface of the second circular disk; and a security device disposed on the roll core insert wherein at least one of the outside planar surface of the first circular disk and the outside planar surface of the second circular disk comprises an engagement mechanism.

2. The roll core insert of claim 1 wherein the body is a rectangular shape and contacts at least a portion of a diameter of the first circular disk and at least a portion of a diameter of the second circular disk.

3. The roll core insert of claim 1 wherein the body is substantially cylindrical, having a diameter equal to or less than the diameter of the first circular disk or the second circular disk.

4. The roll insert of claim 3 wherein the security device is disposed on an exterior surface of the body, which comprises an arc and is not flat.

5. The roll core insert of claim 3 wherein the body is a solid cylinder.

6. The roll core insert of claim 5 wherein the solid cylinder defines channels.

7. The roll core insert of claim 1 wherein the engagement mechanism is a tab.

8. The roll core insert of claim 1 wherein the security device is an electronic surveillance security device.

9. The roll core insert of claim 1 wherein the security device is a radio frequency identification device.

10. A method of using a roll core insert, the method comprising the steps of:

providing a roll core insert of claim 1; and inserting the roll core insert into a roll.

11. The method of claim 10 wherein the roll is a paper roll or a plastic roll.

* * * * *